US005848583A

United States Patent [19]

Smith et al.

[11] Patent Number: 5,848,583

[45] Date of Patent: Dec. 15, 1998

[54] DETERMINING FUEL INJECTION PRESSURE

[75] Inventors: James Craig Smith, Farmington Hills; Darwin Allen Becker, Livonia, both of Mich.

[73] Assignee: Ford Global Technologies, Inc., Dearborn, Mich.

[21] Appl. No.: 237,537

[22] Filed: May 3, 1994

[51] Int. Cl.[6] ..... F02M 37/04

[52] U.S. Cl. ..... 123/497; 123/381; 123/467

[58] Field of Search ..... 123/497, 456, 123/516, 381, 467

[56] References Cited

U.S. PATENT DOCUMENTS

| | | | |
|---|---|---|---|
| 3,669,081 | 6/1972 | Monpetit | 123/497 |
| 3,967,598 | 7/1976 | Rachel | 123/497 |
| 4,260,333 | 4/1981 | Schillinger | 123/497 |
| 4,756,291 | 7/1988 | Cummins et al. . | |
| 4,777,921 | 10/1988 | Miyaki et al. . | |
| 4,800,859 | 1/1989 | Sagisaka | 123/497 |
| 4,823,757 | 4/1989 | Redele | 123/381 |
| 4,836,166 | 6/1989 | Wietelmann | 123/381 |
| 4,889,092 | 12/1989 | Bostwick | 123/381 |
| 4,951,636 | 8/1990 | Tuckey | 123/497 |
| 5,085,193 | 2/1992 | Morikawa . | |
| 5,092,299 | 3/1992 | Muntean | 123/381 |
| 5,191,867 | 3/1993 | Glassey . | |
| 5,237,975 | 8/1993 | Betki et al. . | |
| 5,355,859 | 10/1994 | Weber | 123/497 |

FOREIGN PATENT DOCUMENTS

| | | | |
|---|---|---|---|
| 58-0048768 | 3/1983 | Japan | 123/516 |

*Primary Examiner*—Carl S. Miller
*Attorney, Agent, or Firm*—Peter Abolins

[57] ABSTRACT

This invention includes selecting a desired pressure for fuel injection in an internal combustion engine. The selection improves control of fuel injection by keeping the fuel in the fuel rail in a liquid state and by keeping the fuel injectors in an operating region where fuel injector fuel flow is less sensitive to changes in fuel injector pulse width.

8 Claims, 2 Drawing Sheets

DETERMINING FUEL INJECTION PRESSURE

BACKGROUND OF THE INVENTION

1. Field of the Invention

This invention relates to electronic engine control.

2. Prior Art

For internal combustion (IC) engines, accurately metering fuel into the engine is very important for performance and emissions reasons. For IC engines using fuel injectors to do this metering, a basic system is represented in FIG. 1. In such a production application 10, the mass of fuel being injected ($m_{fuel}$) cannot be measured and controlled directly. However, the fuel mass injected can be closely estimated by the time that an injector orifice 11 of a fuel injector 12 is kept open given that the pressure across the injector is known, and that the fuel is in its liquid state.

Fuel is supplied through a fuel rail 14 and metered into an engine intake manifold 13 by controlling or knowing the injection pressure ($p_{inj}$) and timing how long the injector orifice is kept open. Typically, in current production the injection pressure is virtually constant.

It would be desirable to increase the accuracy of fuel metering by keeping the fuel injections at a pressure where the flow curves are not overly sensitive to commanded pulse widths (on-times). Moreover, at the same time it would be desirable to insure that the fuel inside the fuel rail is at a high enough pressure to keep that fuel completely liquid in spite of temperature extremes.

SUMMARY OF THE INVENTION

This invention determines the pressure at which IC engine fuel injectors should operate by using an algorithm that determines the optimum pressure across the fuel injectors ($P_{inj}$) of an IC engine. In operation, the invention uses as inputs fuel rail temperature and desired mass of fuel to be injected to take into account two main concerns and arbitrate between them. The concerns are keeping the fuel in the fuel rail from boiling, and keeping the injectors in a region where their flow is relatively insensitive to orifice "open" time.

This invention provides the benefits of improved accuracy in fuel metering when compared to known systems. Such benefits include improved vehicle engine performance and reduced emission of combustion gas products.

DETAILED DESCRIPTION OF THE INVENTION

Figure 2:
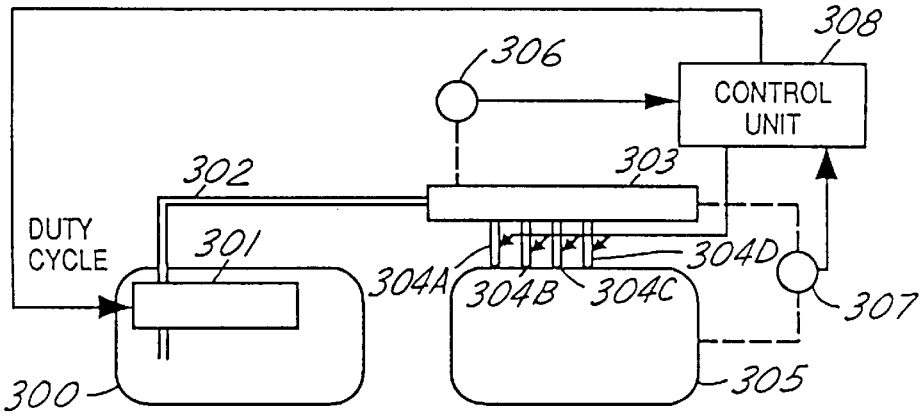
FIG. 2 is a block diagram of a returnless fuel system including a injector pressure processing block in accordance with an embodiment of this invention.
Figure 2A:
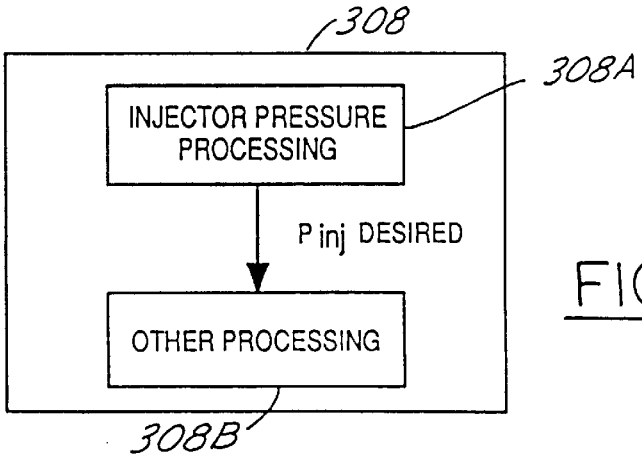
FIG. 2A is a block diagram of the control unit of FIG. 2.

Referring to FIG. 2, a fuel tank 300 includes a fuel pump 301 to pump fuel from fuel tank 300 through a fuel line 302 to a fuel rail 303. Injectors 304A, 304B, 304C, and 304D are coupled to fuel rail 303 and provide for injection of fuel into an engine 305. A fuel temperature sensor 306 is coupled to fuel rail 303. A differential pressure sensor 307 is coupled between fuel rail 303 and engine 305. Differential pressure sensor 307 measures the actual injector pressure by looking at the pressure across the injector. A control unit 308 receives input signals from fuel temperature sensor 306 and differential pressure sensor 307 and provides output signals to fuel injectors 304A, 304B, 304C, 304D to control fuel pulsewidth and to pump 301 to control pump duty cycle and fuel pressure. Control unit 308 is typically a microprocessor with stored processing information as further discussed below. In particular, referring to FIG. 2A, control unit 308 includes an injector pressure processing bock 308A which provides an output of the desired injector pressure to another processing block 308B. Block 308A is further described in connection with FIG. 3.

Figure 3:
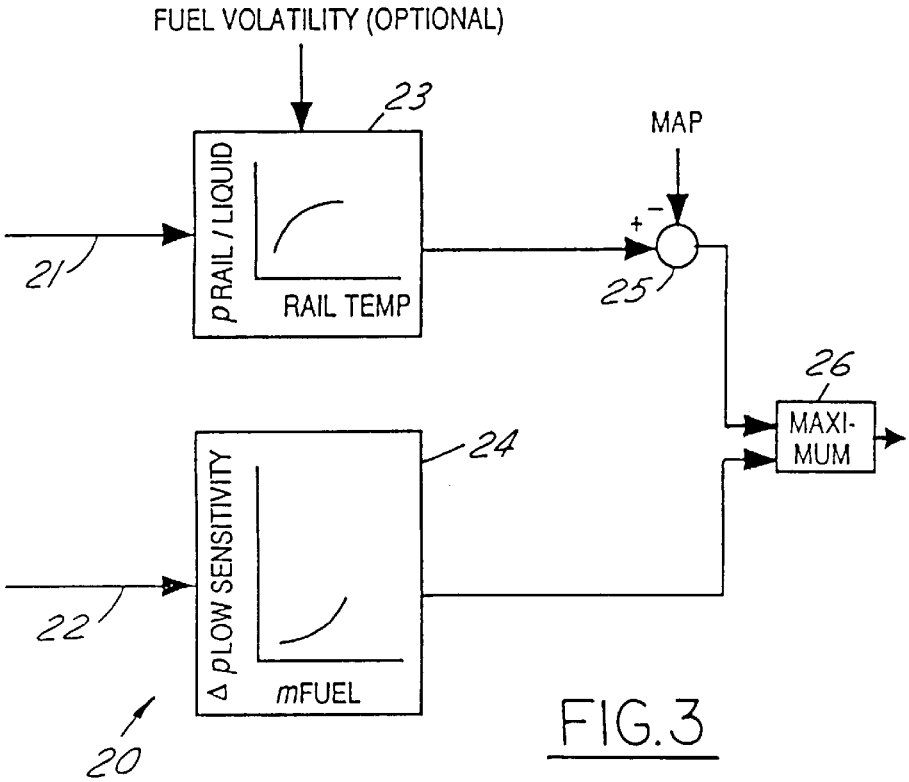
FIG. 3 is a block diagram of the method determining desired fuel injection pressure in accordance with an embodiment of this invention.

The invention includes an algorithm system 20 depicted in block form in FIG. 3. An input 21 (fuel rail temperature) is applied to a block 23 which includes stored data depicting the relationship between rail temperature and the fuel injection pressure needed to keep the fuel in the rail as a liquid. An input 22 (desired mass of fuel to be injected) is applied to a block 24 which includes stored data depicting the relationship between the mass of the fuel to be injected and a fuel injection pressure having a low sensitivity. Low sensitivity means that the commanded pulse width has a relatively low effect on the amount of fuel passing through the fuel orifice of the fuel injector. This is further discussed in connection with FIG. 4.

The output from block 23 is the absolute fuel rail pressure required to keep the fuel in the fuel rail as a liquid and is applied to a summer 25 as a positive input. The engine's manifold absolute pressure (MAP) is applied as a negative input to summer 25. The output of summer 25 is the differential fuel injection pressure required to keep the fuel in the rail as a liquid. The outputs of summer 25 and block 24 are applied to a block 26 as inputs. Block 26 selects the maximum of the two inputs as an output indicating the desired fuel injection pressure. As a result of this process, the desired fuel injection pressure ($P_{inj}$) is the maximum of two candidate $p_{inj}$'s, the first required to keep the fuel in the rail liquid, and the second to keep the injector in a low-sensitivity region of its flow curve (discussed below and shown in FIG. 4).

Figure 1:
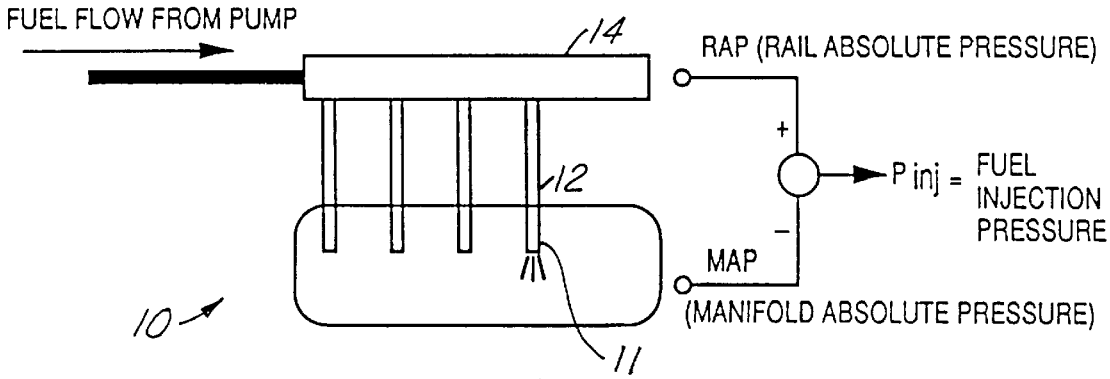
(PRIOR ART) FIG. 1
FIG. 1 is a schematic representation of the fuel intake of an internal combustion engine in accordance with the prior art.

An advantage of the invention is that it keeps the fuel in the fuel rail from boiling. The fuel rail supplying fuel to the injectors is typically mounted to the IC engine which becomes quite hot during normal use. This, in turn, heats the fuel rail and the fuel within it. Fuel flow through the injectors is estimated by the time the orifice in the injector is kept open (fuel pulse width) along with engine speed and the number of injections per engine revolution. In order to accurately meter fuel into the engine using fuel injector pulse widths, the fuel must be completely liquid. As fuel rail temperatures increase, so does the chance that the fuel will begin to vaporize or boil. This can be prevented by keeping the absolute pressure of the fuel inside the fuel rail above a given point. This pressure is denoted as prail/liquid and is not the same parameter as $P_{inj}$ (see FIG. 1). The fuel-temperature-to-fuel-boiling relationship is also a function of fuel volatility. The anti-boil relationship may either assume the worst case (highest volatility), or employ a reed vapor pressure sensor to measure fuel volatility.

Figure 4:
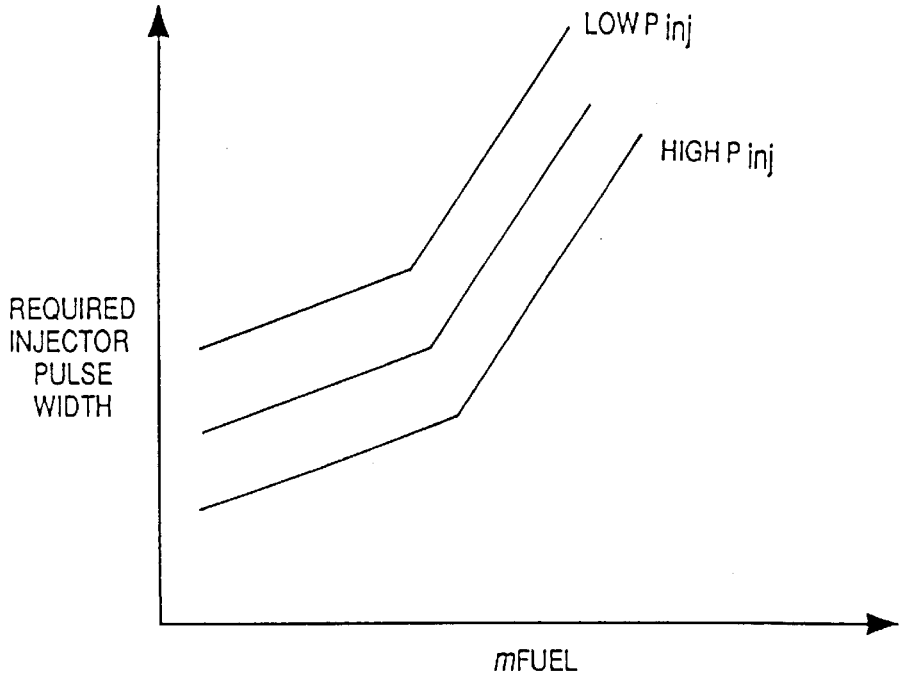
FIG. 4 is a graphical representation of desired mass of fuel to be metered into the engine, and the injector pulse width needed to get that mass using a family of curves for different pressure differentials, in accordance with an embodiment of this invention.

In accordance with an embodiment of this invention, injector operation is kept in a region where fuel injector fuel flow is relatively insensitive to small variations in "injector open" times. The amount of fuel injected is a function of the time the fuel injector's orifice is kept open, the pressure across the injector, the temperature of the fuel and fuel injectors, fuel viscosity, etc. In a situation in which all of these conditions are being kept constant, except for fuel injection pressure, the fuel mass metered per fuel injection versus the fuel injector pulse width would be a family of curves (or a surface if drawn in three dimensions) as shown in FIG. 4.

There are roughly two distinct regions to every curve. One region has a high sensitivity (with a fairly flat slope) and the other has a low sensitivity (with a fairly steep slope). It is desirable to inject at a pressure that is in the low-sensitivity region since controlling the fuel mass being metered is less sensitive to the pulse width being commanded. The problem is that for most of the range of engine operating conditions, there is no one injection pressure that keeps on the low-sensitivity part of a flow curve. The solution is to alter the injection pressure during engine operation to move to an injection curve that has a low-sensitivity for the amount of fuel to be metered out.

In summary, this invention provides for balancing between two pressures which have an important effect on system operation. To arbitrate between these two effects on system operation (keeping the fuel from boiling and keeping the injectors in their low-sensitivity region), the pressures must be put in like terms, either both put in terms of fuel rail pressure (prail or RAP (Rail Absolute Pressure)) or injection pressure ($P_{inj}$). We chose to put them both in terms of $p_{inj}$. Using the relationship in Eq. 1 $p_{rail}$ is converted to $p_{inj\ rail}$.

$$p_{inj}=RAP-MAP \qquad \text{Eq. 1}$$

or specifically $$p_{inj\ rail}=p_{rail}-MAP$$

where

MAP=engine intake Manifold Absolute Pressure, and

RAP=fuel Rail Absolute Pressure.

Since accurate fuel metering is not possible in production engine control systems with fuel that is not completely liquid, the need to keep the fuel liquid outweighs the need to keep the injectors on a low-sensitivity injection curve. This is achieved by calculating both candidate desired $P_{inj}$'s, then using the maximum of the two ($p_{inj\ rail/liquid}$ versus $p_{inj\ low\text{-}sensitivity}$).

Various modifications and variations based on this disclosure will no doubt occur to those skilled in the art to which this invention pertains. Such modifications and variations are considered within the scope of the following claims.

We claim:

1. A method of determining a desired pressure across fuel injectors of an internal combustion engine having a fuel rail coupled to the fuel injectors which have fuel flow curves relating desired fuel mass to be metered into the engine and fuel injector pulse width, including the steps of:

determining a first fuel injection pressure required to keep fuel in the fuel rail liquid;

determining a second fuel injection pressure to keep the fuel injectors operating in a low-sensitivity region of their fuel flow curve; and selecting the larger of the first and second fuel injection pressures as the desired fuel injection pressure to be maintained so as to provide liquid fuel at a minimum absolute fuel injection pressure.

2. A method as recited in claim 1 wherein the step of determining a first fuel injection pressure includes the steps of:

determining the relationship between the fuel rail temperature and the rail pressure needed to keep the fuel liquid;

determining the fuel rail temperature;

determining a fuel rail pressure needed to keep the fuel in the fuel rail liquid; and comparing fuel rail pressure to the manifold absolute pressure so as to determine a fuel injector pressure differential needed to maintain the fuel in the fuel line as a liquid.

3. A method as recited in claim 1 wherein determining the second fuel injection pressure includes the steps of:

storing the relationship between the fuel mass and a pressure differential at a low sensitivity fuel injection operating point;

determining the desired mass of fuel to be injected; and determining the desired pressure differential at a low sensitivity fuel injector operating point.

4. A method as recited in claim 2 wherein the step of comparing fuel rail pressure to the manifold absolute pressure includes the step of summing the manifold absolute pressure as a negative input and the fuel rail pressure as a positive input.

5. An apparatus for determining a desired pressure across fuel injectors of an internal combustion engine having a fuel rail coupled to the fuel injectors, said apparatus including:

means for determining a first fuel injection pressure required to keep fuel in the fuel rail liquid;

means for determining a second fuel injection pressure to keep the fuel injectors operating in a low-sensitivity region of their fuel flow curve; and means for selecting the larger of the first and second fuel injection pressures as the desired fuel injection pressure to be maintained so as to provide liquid fuel at a minimum absolute fuel injection pressure.

6. An apparatus as recited in claim 5 wherein said means for determining a first fuel injection pressure includes:

means for determining the relationship between the fuel rail temperature and the rail pressure needed to keep the fuel liquid;

means for determining the fuel rail temperature;

determining a fuel rail pressure needed to keep the fuel in the fuel rail liquid; and means for comparing fuel rail pressure to the manifold absolute pressure so as to determine a fuel injector pressure differential needed to maintain the fuel in the fuel line as a liquid.

7. An apparatus in claim 5 wherein said means for determining the second fuel injection pressure includes:

means for storing the relationship between the fuel mass and a pressure differential at a low sensitivity fuel injection operating point;

means for determining the desired mass of fuel to be injected; and means for determining the desired pressure differential at a low sensitivity fuel injector operating point.

8. An apparatus as recited in claim 6 wherein said means for comparing fuel rail pressure to the manifold absolute pressure includes means for summing the manifold absolute pressure as a negative input and the fuel rail pressure as a positive input.

* * * * *